US005695150A

United States Patent [19]

Chevet et al.

[11] Patent Number: 5,695,150

[45] Date of Patent: Dec. 9, 1997

[54] STRIP COILER

[75] Inventors: Michel Chevet, Saint-Etienne; Bernard Iwanski, Montbrison, both of France

[73] Assignee: Clecim, Cergy-Pontoise Cedex, France

[21] Appl. No.: 569,777

[22] Filed: Dec. 8, 1995

[30] Foreign Application Priority Data

Dec. 9, 1994 [FR] France ..... 94 14875

[51] Int. Cl.[6] ..... B65H 18/10; B65H 19/22

[52] U.S. Cl. ..... 242/533.6; 242/909

[58] Field of Search ..... 242/533.4, 533.5, 242/533.6, 559.2, 909

[56] References Cited

U.S. PATENT DOCUMENTS

| | | | |
|---|---|---|---|
| 2,691,490 | 10/1954 | Gerard | 242/533.5 |
| 2,923,487 | 2/1960 | Wands et al. | 242/533.5 |
| 2,969,930 | 1/1961 | Zernov | 242/533.5 |
| 3,228,621 | 1/1966 | Ryan | 242/533.5 |
| 3,930,620 | 1/1976 | Taitel | 242/533.6 |
| 3,985,313 | 10/1976 | Klein et al. | 242/533.5 |
| 4,488,687 | 12/1984 | Andreasson | 242/533.6 |

FOREIGN PATENT DOCUMENTS

| | | |
|---|---|---|
| 0067127 A1 | 12/1982 | European Pat. Off. . |
| 0407070 A2 | 1/1991 | European Pat. Off. . |
| 3346219 A1 | 7/1985 | Germany . |
| 3419316 A1 | 12/1985 | Germany . |

OTHER PUBLICATIONS

Japanese Abstract, Nagasaka, "Double Drum Type Winding And Unwinding Machine", vol. 8, No. 108 (M-297) (1545), May 19, 1984, published Jan. 31, 1984.

Japanese Abstract, Michinori, "Multiple Drum Type Winder/Rewinder", vol. 10, No. 281 (M-520), Sep. 25, 1986, published May 20, 1986.

Japanese Abstract, Michinori, "Double Drum Type Winder Or Unwinder", vol. 10, No. 315 (M-529), Oct. 25, 1986, published Jun. 12, 1986.

*Primary Examiner*—John M. Jillions

*Attorney, Agent, or Firm*—Pollock, Vande Sande & Priddy

[57] ABSTRACT

Coiler for winding a strip product, comprising a supporting frame (1) supported, on at least one side, by a hollow tubular shaft (2) rotating in at least one fixed bearing (21) centered about an axis (x'x) of rotation of the frame, at least two winding mandrels (3a, 3b) each mounted on an off-centered shaft of rotation (31), each mandrel shaft (31) being fitted into and locked in rotation with a tubular sleeve (5) supported by two spaced bearings (51) each mounted in a crown (52) fixed onto said rotating frame (1). At least two autonomous motors (6) provide rotational drive, respectively, for the two mandrels (3a, 3b), and each comprises a rotor (62) fitted over and locked in rotation with the tubular sleeve (5) and a stator (61) mounted on a side wall (53) extending between and attached to the crowns (52). The autonomous motors (6) are associated with power supply circuits passing through the inside of the tubular shaft (2) of the rotating frame (1) and linked to a power source via a rotating connecting device (64).

10 Claims, 3 Drawing Sheets

STRIP COILER

FIELD OF THE INVENTION

This invention relates to a coiler for winding a strip product, usable in particular in a metal strip coiling installation.

BACKGROUND OF THE INVENTION

In a rolling installation, the metal strip must be wound into coils, at the output of the installation, to allow it to be easily transported to another part of the installation or any other place of use.

To this end, coilers are used made up of a mandrel driven in rotation about its axis and on which the strip is wound to form a coil. The mandrel is provided, in a conventional manner, with retractable expansion means allowing the coil to be removed after winding, and is associated with supplementary devices such as a belt type strip engaging device allowing the start of the winding, and means for removing wound coils.

In some installations, particularly in those working in continuous flow, such as coupled rolling mills or lines, the output equipment provided must be specially adapted to large production capacities.

In particular, as soon as a coil reaches the required size, the strip must be sheared and immediately engaged into another coiler. A strip accumulator is used to avoid having to stop rolling while the coiler is being changed over, the time required naturally being kept as short as possible.

Normally, such an installation comprises two independent coilers each having a belt type strip engaging device and a coil removal carriage. The transfer of the product, after shearing, from one coiler to the other, is ensured by a switching system. Such an arrangement is very bulky and expensive, particularly because of the cost of the infrastructure required.

To reduce the spatial requirements of the coiling installation, it has already been proposed of a single machine in place of the two independent coilers, such a machine comprising two winding mandrels mounted on a drum rotatable about an axis in order to successively place one of the mandrels in the strip winding position. This type of coiler only requires a single belt type strip engaging device and a single coil removal carriage, and this significantly reduces the infrastructure costs. Moreover, since the engagement geometry of the strips is constant, the switching device is no longer required.

To allow the positioning of one of the mandrels and separate control of the rotation of the mandrel in the winding position, existing installations of this type are mechanically very complicated and require numerous gears, transmission shafts, bearings, clutches, claws, etc.

SUMMARY OF THE INVENTION

The present invention overcomes these drawbacks by means of a coiler having at least two mandrels whose structural arrangements are extremely simplified compared to existing versions, and makes possible substantial space savings as well as a reduction in maintenance costs and high reliability and availability.

According to the invention, the coiler comprises:

a rotating supporting frame, mounted for rotation about a horizontal axis x'x and supported, on at least on one side, by a hollow tubular shaft rotating in at least one fixed bearing centered about said axis x'x, at least two winding mandrels extending in a cantilevered way from the side opposite the hollow shaft, each in the extension of a rotational shaft having an axis y'y parallel to the axis x'x of rotation of the rotating frame and off-centered with respect to it, each mandrel shaft being fitted into a tubular sleeve rigidly locked in rotation with the shaft and supported by two spaced bearings each having an inner housing fixed onto the tubular sleeve and an outer housing mounted in a crown fixed onto the rotating frame, at least two autonomous motors providing rotational drive, respectively, for the two mandrels, each autonomous motor comprising a rotor fitted over and fixed in rotation with the tubular sleeve and a stator mounted on a side wall extending between and attached to the crowns, means for supplying power to the autonomous motors, comprising circuits passing through the inside of the tubular shaft of the rotating frame and linked to an energy source via a rotating connecting device, means for controlling the rotation of the frame about its axis (x'x) in order to position one of the mandrels in the strip winding position, means for selectively controlling one of the motors in order to wind a coil on the corresponding mandrel.

According to a further embodiment of the invention, the coiler is advantageously associated with means for blowing a coolant fluid into the tubular shaft and which is able to escape through ports at the level of the frame by passing along the stators of the motors in order to cool the motors from the outside.

According to a particularly advantageous embodiment, the rotating frame is made up of a cylindrical drum in the form of a hollow case defined by a cylindrical side casing and two spaced circular flanges, centered about and perpendicular to the tubular shaft, and on which are mounted the supporting crowns, respectively, of the two centering bearings of each mandrel shaft.

Preferably, the drum is provided with two parallel flat bulkheads arranged symmetrically on either side of a diametral plane passing through the axis of rotation and extending up to the cylindrical side wall of the drum so as to define a central space which opens to the outside through two diametrically opposed ports provided on the periphery of the drum between the ends of the bulkheads, the two motors of the mandrels being located in the central space on either side of the axis of the drum.

In a particularly advantageous way, the stator of each motor is provided with cooling fins made up of spaced walls extending transversely to the axis of the motor between the two flat bulkheads and welded onto the bulkheads so as to strengthen the rigidity of the drum at the level of the central space.

BRIEF DESCRIPTION OF THE DRAWINGS

The invention will be better understood from the following description of a particular embodiment, given by way of example and shown in the attached drawings.

DESCRIPTION OF PREFERRED EMBODIMENT

Figure 1:
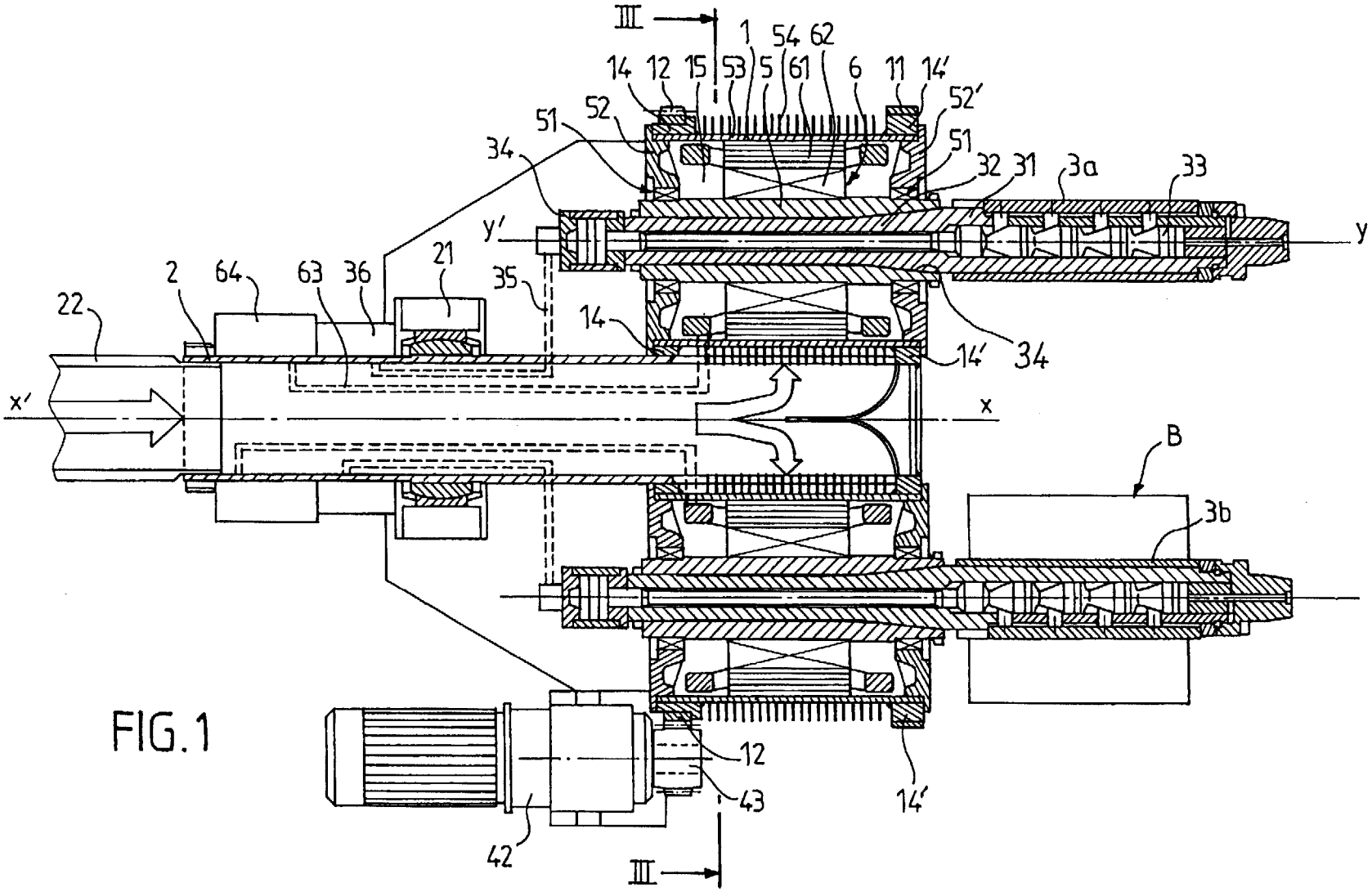
FIG. 1 shows the overall coiler in longitudinal section along line I—I in FIG. 2.

FIG. 1 shows a longitudinal section of the overall coiler comprising a supporting frame constituted by a drum 1, mounted for rotation about a central shaft 2 defining an axis of rotation x'x of the frame. The frame supports two winding mandrels 3a, 3b, each mounted on a shaft 31 extending in a cantilevered way outwardly from the drum and defining an axis of rotation y'y of the mandrel parallel to the axis of rotation x'x of the frame.

Figure 2:
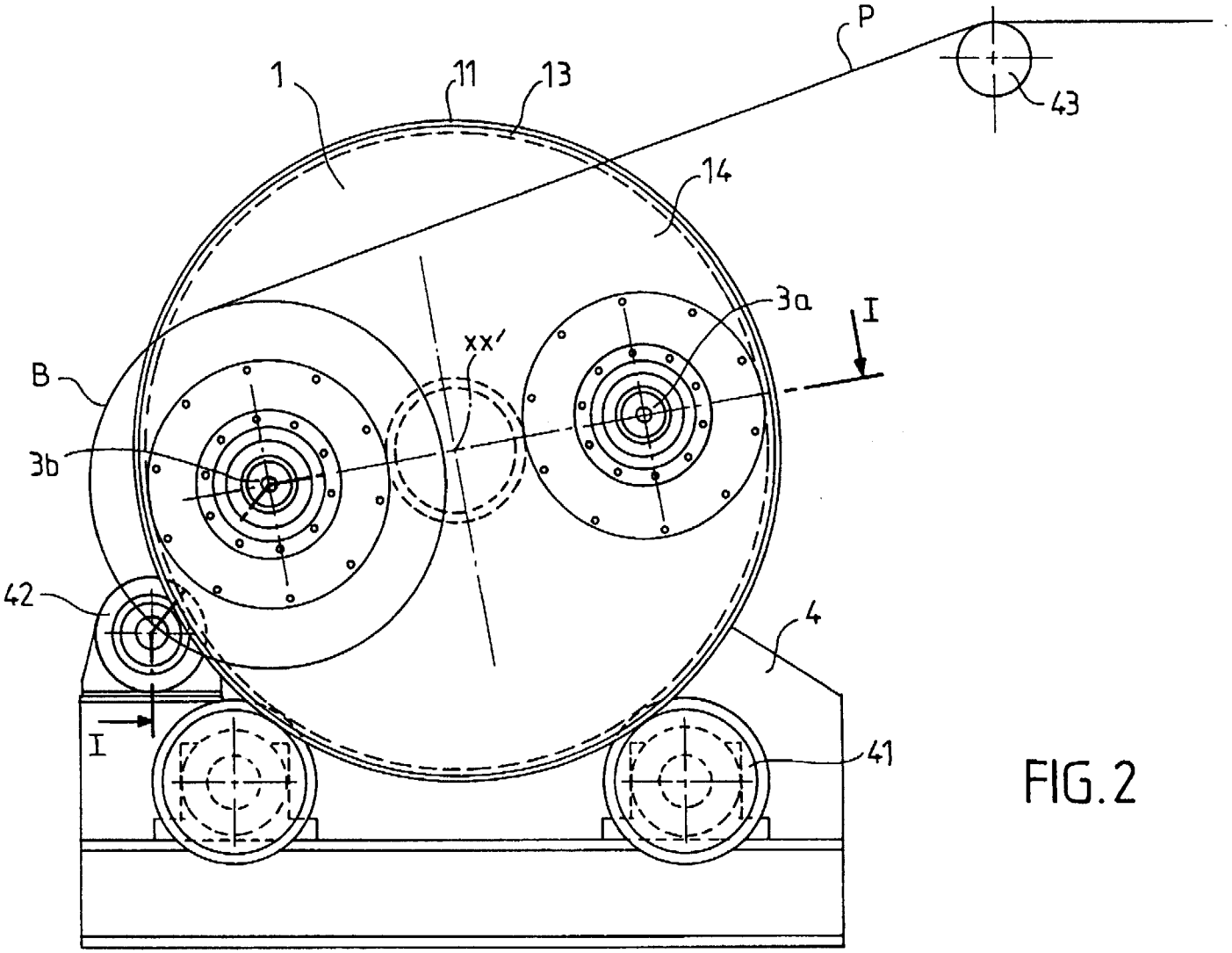
FIG. 2 is a front elevation view of the coiler.
Figure 3:
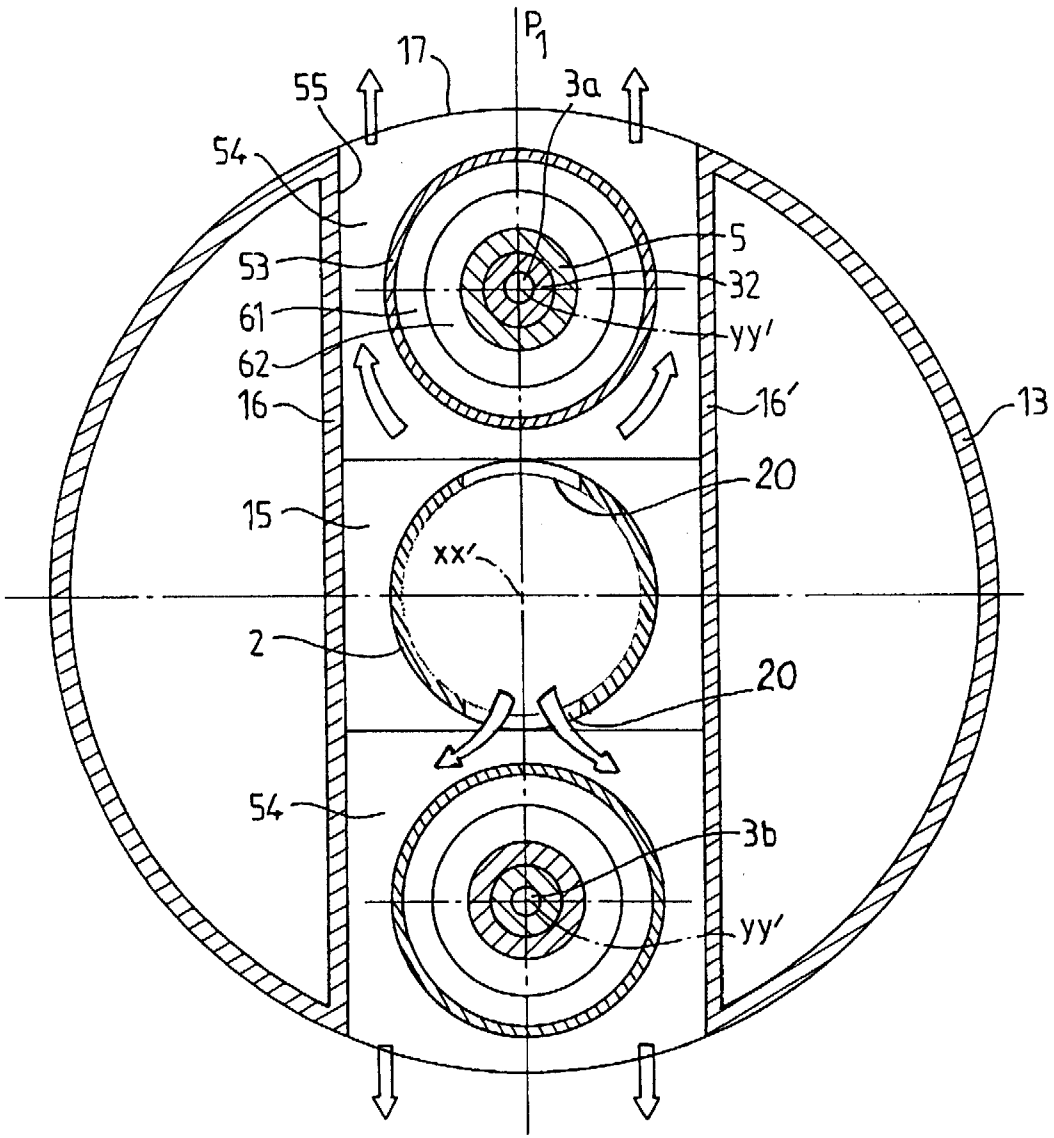
FIG. 3 is a cross-sectional view along line III—III in FIG. 1.

As shown particularly in FIGS. 1 and 2, supporting shaft 2 of frame 1 extends outwardly from the side opposite side to mandrels 3a, 3b, and is supported by a fixed bearing 21, the periphery of frame 1 on the mandrel side being provided with a circular rim 11 which rolls on two spaced rollers 41 mounted for rotation on a supporting structure 4 of the assembly and defining the position of the axis of rotation x'x of frame 1 on which the circular rim 11 is centered.

The supporting structure 4 also supports a geared orientation motor 42 driving a gear 43 which meshes with a circular crown gear 12 provided on the periphery of frame 1 so as to orientate said frame. As a result, as shown in FIG. 2, it is possible to place one or the other of mandrels 3a, 3b in the engagement position to wind a strip P passing on a fixed guide roller 43 so as to form a coil B.

In a conventional manner, each of mandrels 3a, 3b associated with an expansion system 33 located inside shaft 31 of the mandrel which is supported in a cantilevered way by its part 32 located at the level of frame 1 and whose end opposite from mandrel 3 is fitted with a jack 34 controlling the expansion of the mandrel which acts on the expansion device 33 by means of a rod passing through a central bore in the inner part 32 of the shaft.

In the embodiment shown in the drawings, frame 1 is made up of a drum forming a hollow case defined by a cylindrical casing 13 and two circular flanges 14 spaced apart from each other and perpendicular to the x'x axis of the drum. Inside the case thus defined, a central space 15 is provided defined by two bulkheads 16, 16', parallel to each other and symmetrical in relation to a diametral plane P1 of the drum passing through the x'x axis of the drum and on which lie the y'y axes of the two mandrels 3a, 3b.

The rotational shaft 2 of the drum 1 is made up of a tube fixed into two bore holes in the center of flanges 14, 14'and is provided with ports 20 leading to the inside of the central space 15.

The inner part 32 of the shaft 31 of each mandrel is fitted inside a tubular sleeve 5 supported by two spaced bearings 51 each comprising an inner housing fitted over an end of the tubular sleeve 5 and an outer housing mounted in a crown 52, 52' fixed onto frame 1.

In the illustrated, embodiment each crown is fitted into a conjugate bore hole provided on the corresponding flange 14 of drum 1 and centered on the y'y axis of each mandrel.

The stator 61 of an electric motor 6 is mounted on the inner face of a cylindrical wall 53 extending between the two crowns 52, 52' of the two bearings. The rotor 62 of motor 6 is fitted over and fixed to tubular sleeve 5. The latter is rigidly locked in rotation with the inner part 32 of shaft 31 of the mandrel by grooves which rigidly lock shaft 31, 32 in rotation with the tubular sleeve 5, while at the same time making it possible to remove shaft 31 and mandrel 3 by effecting an axial sliding movement.

The mandrel side of tubular sleeve 5 is provided with a recessed conical bearing surface in which a conjugate conical bearing surface 34 of shaft 31 engages in order to center the latter.

Cooling fins 54, fitted onto the cylindrical wall 53, are made up of thin, substantially rectangular walls spaced apart from each other and and comprising two lateral edges 55 welded respectively welded onto the two bulkheads 16, 16'.

The outer end of tubular shaft 2 can be connected, to a conduit 22 linked to a fan for blowing a coolant fluid which enters inside drum through ports 20 in the opposite end of tubular shaft 2. The coolant fluid flows into the two parts of the central space 15 from where it vents to the outside via widely open ports 17 provided on the periphery of the drum, between the two bulkheads 16, 16'. The coolant fluid, generally air, thus passes along the fins 54 and cools the motor 6 from the outside.

The flow rate of the fan and the cross-section of tubular shaft 2 are chosen so as to supply the air required to cool the two motors.

The tubular shaft 2 is also used to supply power to the two mandrels. In particular, each motor 6 is associated with a power circuit 63 connected to a circular power connector 64 mounted on the end of shaft 2 and which is itself linked to an electric power source. Likewise, mandrel expansion devices 34 are connected to hydraulic circuits 35 linked to a pressure source via a rotating joint 36 mounted on shaft 2 next to the circular connector 64. Conventional means are used to supply electric and hydraulic power to one or the other of mandrels 3a, 3b.

Due to these arrangements, the working of the two mandrels can be selectively controlled by means of autonomous motors housed entirely in drum 1 without any subsequent increase in the spatial requirements of the installation and without obstructing the rotation of the drum when positioning the mandrels.

Indeed, as can be seen in FIG. 2, it is possible to fully wind a coil B onto mandrel 3b located on the downstream of the coiler in relation to the product feed direction. When the coil has reached the required size, conventional means, (not shown) are used to shear the product P and to immediately engage it on mandrel 3a located upstream and associated with a belt type strip engaging device (not shown).

During this time, coil B is removed from mandrel 3b.

After starting and winding on the first turns of the coil, the gear motor 42 rotates drum 1 through 180° to position mandrel 3a in the downstream position, mandrel 3b being thus in the upstream engagement position.

The position is thus the position shown in FIG. 2 allowing winding to continue on mandrel 3a, now in the downstream position.

The use of side fins to cool the motors and at the same time enhance the rigidity of the drum is particularly advantageous, but other methods of cooling can be used.

The drum assembly could be constructed differently. In particular, other easy-to-design means could be employed to ensure its support, driving and power supply.

In addition, while in the described embodiment the mandrels are driven by electric motors, hydraulic control could also be used.

It should also be noted that because of the low spatial requirements of the arrangements used, it would be possible to place three or possibly four mandrels on the same drum if the need arose.

We claim:

1. A coiler for winding a strip product, said coiler comprising:

(a) a rotating supporting frame mounted for rotation about a horizontal axis and supported, on at least one side, by a hollow tubular shaft rotating in at least one fixed bearing centered about said axis, said rotating frame defining a central space;

(b) at least two winding mandrels each extending in a cantilevered manner from a side remote from said hollow shaft in an extension of a rotational shaft having an axis parallel and off-centered relative to said axis of rotation of said rotating frame;

(c) each mandrel shaft being supported by two spaced bearings each having an outer housing mounted in a crown fixed into said rotating frame;

(d) at least two autonomous rotational drive motors, respectively, for said at least two mandrels, each autonomous motor being located in a central space of said rotating frame and comprising a rotor fixed in rotation with said shaft of said mandrel, and a stator mounted on a side wall extending between and attached to said crowns;

(e) means for supplying power to said autonomous motors, said means comprising circuits passing through an inside of said tubular shaft of said rotating frame and linked to an energy source via a rotating connecting device;

(f) means for controlling rotation of said rotating frame about its axis in order to position one of said mandrels in a strip winding position;

(g) means for selectively controlling one of said autonomous motors in order to wind a coil on a corresponding mandrel;

(h) means for blowing a coolant fluid into said tubular shaft, said shaft being provided with through ports leading into said central space;

(i) said coolant fluid flowing into said central space and passing along stators of said motors in order to cool said motors from the outside.

2. The coiler according to claim 1, wherein each mandrel shaft is fitted into a tubular sleeve rigidly locked in rotation with said shaft and supported by two spaced bearings each having an inner housing fixed onto the tubular sleeve.

3. The coiler according to claim 1 or 2, wherein said rotating frame is supported, on the side of said mandrels, by a circular rim centered about the axis of rotation of said tubular shaft and rolling on two spaced supporting rollers.

4. The coiler according to claim 1 or 2, wherein said rotating frame is constituted by a cylindrical drum in the form of a hollow case defined by a cylindrical side and two spaced circular flanges, centered about and perpendicular to said tubular shaft, and on which are mounted said crowns, respectively, of the two centering bearings of each mandrel shaft.

5. The coiler according to claim 4, wherein said drum is provided with two parallel flat bulkheads arranged symmetrically on either side of a diametral plane passing through said axis of rotation of said tubular shaft and between which said autonomous motors are housed.

6. The coiler according to claim 5, wherein said two bulkheads define a central space which opens to an exterior through two diametrically opposed ports provided on said cylindrical side of said drum between ends of said bulkheads, said autonomous motors of said mandrels being located in said central space, on either side of the axis of said drum.

7. The coiler according to claim 5, wherein the side wall supporting the stator of each autonomous motor is associated with a plurality of cooling fins made up of spaced walls extending transversely to the axis of the autonomous motor between the two flat bulkheads and welded onto said bulkheads so as to strengthen rigidity of said drum at a level of said central space.

8. The coiler according to claim 1, wherein said rotational shaft of each mandrel comprises an inner part which is fitted into and locked in rotation with said tubular sleeve, while being able to slide axially so as to allow said rotational shaft to be removed, said tubular sleeve on the mandrel side being provided with a recessed conical bearing surface which cooperates with a conjugate conical part of said rotational shaft to center said rotational shaft.

9. The coiler according to claim 1 or 2, wherein the rotational control means of each mandrel is an electric motor.

10. The coiler according to claim 1 or 2, wherein the rotational control means of each mandrel is an hydraulic motor.

* * * * *